US010005979B2

(12) United States Patent
Saccomando et al.

(10) Patent No.: US 10,005,979 B2
(45) **Date of Patent: *Jun. 26, 2018**

(54) LUBRICANT COMPOSITION CONTAINING AN ANTIWEAR AGENT

(71) Applicant: The Lubrizol Corporation, Wickliffe, OH (US)

(72) Inventors: Daniel J. Saccomando, Belper (GB); William R. S. Barton, Belper (GB); Ewan E. Delbridge, Concord Township, OH (US); Shawn Dickess, Cincinnati, OH (US); Michael R. Sutton, Belper (GB); Stephen J. Cook, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/309,140

(22) PCT Filed: May 6, 2015

(86) PCT No.: PCT/US2015/029339

§ 371 (c)(1),
(2) Date: Nov. 4, 2016

(87) PCT Pub. No.: WO2015/171676

PCT Pub. Date: Nov. 12, 2015

(65) Prior Publication Data

US 2017/0073604 A1 Mar. 16, 2017

Related U.S. Application Data

(60) Provisional application No. 61/989,239, filed on May 6, 2014.

(51) Int. Cl.

| | |
|---|---|
| ***C10M 137/08*** | (2006.01) |
| ***C10M 159/12*** | (2006.01) |
| ***C10M 137/10*** | (2006.01) |

(52) U.S. Cl.

CPC ..... *C10M 137/08* (2013.01); *C10M 137/105* (2013.01); *C10M 159/123* (2013.01); *C10M 2203/1006* (2013.01); *C10M 2203/1025* (2013.01); *C10M 2205/022* (2013.01); *C10M 2205/028* (2013.01); *C10M 2205/0285* (2013.01); *C10M 2205/04* (2013.01); *C10M 2205/06* (2013.01); *C10M 2205/08* (2013.01); *C10M 2207/026* (2013.01); *C10M 2207/028* (2013.01); *C10M 2207/127* (2013.01); *C10M 2207/262* (2013.01); *C10M 2209/084* (2013.01); *C10M 2215/04* (2013.01); *C10M 2215/064* (2013.01); *C10M 2215/08* (2013.01); *C10M 2215/223* (2013.01); *C10M 2215/224* (2013.01); *C10M 2215/28* (2013.01); *C10M 2217/043* (2013.01); *C10M 2219/022* (2013.01); *C10M 2219/046* (2013.01); *C10M 2219/089* (2013.01); *C10M 2219/104* (2013.01); *C10M 2219/106* (2013.01); *C10M 2223/045* (2013.01); *C10N 2230/04* (2013.01); *C10N 2230/06* (2013.01); *C10N 2230/12* (2013.01); *C10N 2230/36* (2013.01); *C10N 2230/42* (2013.01); *C10N 2230/43* (2013.01); *C10N 2230/45* (2013.01); *C10N 2230/52* (2013.01); *C10N 2230/54* (2013.01); *C10N 2240/10* (2013.01); *C10N 2260/14* (2013.01)

(58) Field of Classification Search

CPC ..... C10M 133/58; C10M 137/08; C10M 137/105; C10M 159/123; C10M 2203/1006; C10M 2203/1025; C10M 2205/022; C10M 2205/028; C10M 2205/0285; C10M 2205/04; C10M 2205/06; C10M 2205/08; C10M 2207/026; C10M 2207/028; C10M 2207/127; C10M 2207/262; C10M 2209/084; C10M 2215/04; C10M 2215/064; C10M 2215/08; C10M 2215/223; C10M 2215/224; C10M 2215/28; C10M 2217/043; C10M 2219/046; C10M 2219/089; C10M 2219/104; C10M 2219/106; C10M 2223/045; C10N 2230/04; C10N 2230/06; C10N 2230/12; C10N 2230/36; C10N 2230/42; C10N 2230/43; C10N 2230/45; C10N 2230/54

See application file for complete search history.

(56) References Cited

U.S. PATENT DOCUMENTS

| | | | | |
|---|---|---|---|---|
| 3,397,145 A | | 8/1968 | Cyba et al. | |
| 4,002,569 A | * | 1/1977 | Rubin | C07C 69/00 508/476 |
| 9,738,848 B2 | * | 8/2017 | Takata | C10M 137/04 |

FOREIGN PATENT DOCUMENTS

| | | | | |
|---|---|---|---|---|
| WO | 2013013026 A1 | | 1/2013 | |
| WO | WO 2013013026 A1 | * | 1/2013 | C07D 207/277 |

* cited by examiner

*Primary Examiner* — James Goloboy
(74) *Attorney, Agent, or Firm* — Eryn Ace Fuhrer; Teresan W. Gilbert

(57) ABSTRACT

The invention provides a lubricant composition comprising an oil of lubricating viscosity and 0.01 wt % to 15 wt % of a (thio)phosphoric acid salt of an N-hydrocarbyl-substituted gamma- (γ-) or delta-amino(thio)ester. The invention further relates to a method of lubricating a mechanical device with the lubricant composition.

39 Claims, No Drawings

LUBRICANT COMPOSITION CONTAINING AN ANTIWEAR AGENT

CROSS REFERENCE TO RELATED APPLICATION

This application claims priority from PCT Application Serial No. PCT/US2015/029339 filed on May 6, 2015, which claims the benefit of U.S. Provisional Application No. 61/989,239 filed on, May 6, 2014.

FIELD OF INVENTION

The invention provides a lubricant composition comprising an oil of lubricating viscosity and 0.01 wt % to 15 wt % of a (thio)phosphoric acid salt of an N-hydrocarbyl-substituted gamma- (γ-) or delta- (δ-) amino(thio)ester. The invention further relates to a method of lubricating a mechanical device with the lubricant composition.

BACKGROUND OF THE INVENTION

Phosphorus chemistry such as zinc dialkyldithiophosphate (ZDDP), and amine phosphates, are known anti-wear agents in many lubricants. It is believed that phosphorus chemistry ZDDP antiwear additives protects metal surface of mechanical devices by forming a protective film on metal surfaces. However, many phosphorus antiwear agents have been identified as having some detrimental impact on either the mechanical devices being lubricated, or on the environment.

For example, engine lubricants containing phosphorus and sulphur compounds such as ZDDP have been shown to contribute in part to particulate emissions and emissions of other pollutants. In addition, sulphur and phosphorus tend to poison the catalysts used in catalytic converters, resulting in a reduction in performance of said catalysts.

There has been a commercial trend for reduction in emissions (typically reduction of NOx formation, SOx formation) and a reduction in sulphated ash in engine oil lubricants.

In engine lubrication ashless phosphorus chemistry such as amine phosphates is believed to in part result in increased corrosion, typically lead and/or copper corrosion. Copper and lead corrosion may be from bearings and other metal components derived from alloys using copper or lead. Amine salts are also known to contribute to the degradation of fluorocarbon seals.

SUMMARY OF THE INVENTION

The objectives of the present invention include providing a lubricant composition having at least one of the following properties (i) reduced or equivalent wear, (ii) reduced lead or copper corrosion, (iii) retention of total base number of the lubricant, (iv) decreased deposit formation, (v) improved fuel economy and/or (vi) improved seal compatibility in the operation of a mechanical device. In one embodiment the invention provides for a lubricating composition containing an amine salted (thio)phosphate utilized to reduce/prevent wear without harming seals.

As used herein, reference to the amounts of additives present in the lubricant composition disclosed are quoted on an oil free basis, i.e., amount of actives, unless otherwise indicated.

It is known to those skilled in the art that acid-base salts, such as those of the invention, need not be stoichiometric;

that is, there may be an excess of acid over base or base over acid. In one embodiment, the amine salt of the invention contains up to 50% equivalent excess of acid (i.e. there are 1.5 equivalents of acid (or TAN—total acid number) per 1 equivalent of amine base (or TBN—total base number)). In other embodiments, the ratio of acid to amine base is 1.5:1 to 1:1.5, or 1.3:1 to 1:1.3, or 1.1:1 to 1:1.1, all on an equivalent basis.

As used herein, the transitional term "comprising", which is synonymous with "including", "containing", or "characterized by", is inclusive or open-ended and does not exclude additional, un-recited elements or method steps. However, in each recitation of "comprising" herein, it is intended that the term also encompass, as alternative embodiments, the phrases "consisting essentially of" and "consisting of", where "consisting of" excludes any element or step not specified and "consisting essentially of" permits the inclusion of additional un-recited elements or steps that do not materially affect the basic and novel characteristics of the composition or method under consideration.

As used herein the expression "amino(thio)ester" is intended to include an aminothioester or an aminoester. Typically the amino(thio)ester may be an aminoester, or mixtures thereof.

As used herein the expression "(thio)phosphoric acid" is intended to include thiophosphoric acid, phosphoric acid (i.e., no sulphur present within the acid), mono- or dihydrocarbyl phosphate ester-acids, or mixtures thereof. Typically the (thio)phosphoric acid may be a phosphoric acid, or mixtures thereof.

In one embodiment the present invention provides a lubricant composition comprising an oil of lubricating viscosity and 0.01 wt % to 15 wt % of a (thio)phosphoric acid salt of an N-hydrocarbyl-substituted gamma- (γ-) or delta- (δ-) amino(thio)ester.

The (thio)phosphoric acid salt may be a salt of N-hydrocarbyl-substituted gamma- (γ-) or delta- (δ-) amino(thio) ester.

The (thio)phosphoric acid salt may be a salt of N-hydrocarbyl-substituted gamma- (γ-) amino(thio)ester.

The amino(thio)ester may comprise a N-hydrocarbyl-substituted gamma-amino(thio)ester.

The amino(thio)ester comprises a N-hydrocarbyl-substituted gamma-aminoester.

The amino(thio)ester may comprise a 2-((hydrocarbyl) aminomethyl) succinic acid dihydrocarbyl ester. The ester functionality may comprise an alcohol-derived group which is a hydrocarbyl group having 1 to about 30 carbon atoms.

The ester functionality may comprise an alcohol-derived group which is an ether-containing group.

The amino(thio)ester may be an ester and comprises a second ester functionality, and wherein the two alcohol-derived groups of the ester functionalities are alkyl moieties which are the same or different and have 1 to about 18 carbon atoms.

In one embodiment the (thio)phosphoric acid salt of an N-hydrocarbyl-substituted amino(thio)ester may be obtained/obtainable by reacting an N-hydrocarbyl-substituted gamma- (γ-) or delta- (δ-) amino(thio)ester, with a (thio)phosphoric acid, ester, or a partial acid-ester thereof.

In one embodiment the amino(thio)ester may have a N-hydrocarbyl substituent that comprises a hydrocarbyl group of at least 3 carbons atoms, with a branch at the 1 or 2 position of the hydrocarbyl group, provided that if the ester or thioester is a methyl ester or methyl thioester then the hydrocarbyl group has a branch at the 1 position, and further provided that the hydrocarbyl group is not a tertiary group of an N-hydrocarbyl-substituted amino(thio)ester, and may be obtained/obtainable by reacting the N-hydrocarbyl-substituted amino(thio)ester with a (thio)phosphoric acid, ester, or a partial acid-ester thereof.

In one embodiment the amino(thio)ester may have a N-hydrocarbyl substituent that comprises a hydrocarbyl group of at least 3 carbons atoms, with a branch at the 1 or 2 position of the hydrocarbyl group, provided that if the ester or thioester is a methyl ester or methyl thioester then the hydrocarbyl group has a branch at the 1 position, and further provided that the hydrocarbyl group is a tertiary group of an N-hydrocarbyl-substituted amino(thio)ester, and may be obtained/obtainable by reacting the N-hydrocarbyl-substituted amino(thio)ester with a (thio)phosphoric acid, ester, or a partial acid-ester thereof.

In one embodiment the invention provides for the use of 0.01 wt % to 15 wt % of a (thio)phosphoric acid salt of an N-hydrocarbyl-substituted gamma- (γ-) or delta-(δ-) amino (thio)ester, in a lubricant as at least one of an antiwear agent, corrosion inhibitor (typically lead or copper corrosion). The (thio)phosphoric acid salt disclosed herein may also be compatible with seals.

In one embodiment the invention provides a method of lubricating an internal combustion engine comprising supplying to the internal combustion engine a lubricant disclosed herein.

The lubricant may have a SAE viscosity grade of XW-Y, wherein X may be 0, 5, 10, or 15; and Y may be 16, 20, 30, or 40.

The oil of lubricating viscosity may comprise an API Group I, II, III, IV, V, or mixtures thereof base oil.

In another embodiment the invention provides a lubricant composition characterised as having at least one of (i) a sulphur content of 0.1 wt % to 0.4 wt % or less, (ii) a phosphorus content of 0.03 wt % to 0.15 wt %, and (iii) a sulphated ash content of 0.5 wt % to 1.5 wt % or less.

In a further embodiment the invention provides the lubricant characterised as having (i) a sulphur content of 0.5 wt % or less, (ii) a phosphorus content of 0.1 wt % or less, and (iii) a sulphated ash content of 0.5 wt % to 1.5 wt % or less.

The internal combustion engine may have a steel surface on a cylinder bore, a cylinder block, or a piston ring.

The internal combustion engine may be spark ignition or compression ignition. The internal combustion engine may be a 2-stroke or 4-stroke engine. The internal combustion engine may be a passenger car engine, a light duty diesel engine, a heavy duty diesel engine, a motorcycle engine, or a 2-stroke or 4-stroke marine diesel engine. Typically the internal combustion engine may be a passenger car engine, or a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

In one embodiment the invention provides for a method of lubricating an internal combustion engine comprising supplying to the internal combustion engine a lubricant composition disclosed herein.

In one embodiment the invention provides for the use of the (thio)phosphoric acid salt disclosed herein as an antiwear agent, or a friction modifier (typically to improve fuel economy) in an engine lubricant.

DETAILED DESCRIPTION OF THE INVENTION

The present invention provides a lubricant composition, a method for lubricating a mechanical device and the use as disclosed above.

In one embodiment the (thio)phosphoric acid salt comprises a (thio)phosphoric acid salt of a N-hydrocarbyl-substituted gamma-amino(thio)ester.

The (thio)phosphoric acid may comprise a mono- or di-hydrocarbyl (thio)phosphoric acid (typically alkyl (thio) phosphoric acid), or mixtures thereof.

The alkyl of the mono- or di-hydrocarbyl (thio)phosphoric acid may comprise linear alkyl groups of 3 to 36 carbon atoms.

The alkyl of the mono- or di-hydrocarbyl (thio)phosphoric acid may comprise branched alkyl groups of 3 to 36 carbon atoms.

The hydrocarbyl group of the linear or branched the hydrocarbyl (thio)phosphoric acid may contain 4 to 30, or 8 to 20 carbon atoms in the form of a linear chain.

If improved fuel economy is required, the hydrocarbyl (thio)phosphoric acid may contain a predominantly linear hydrocarbyl group of 3 to 36 4 to 30, or 8 to 20 carbon atoms.

Examples of a suitable hydrocarbyl group of the hydrocarbyl (thio)phosphoric acid may include isopropyl, n-butyl, sec-butyl, amyl, 4-methyl-2-pentyl (i.e. methylamyl), n-hexyl, n-heptyl, n-octyl, iso-octyl, 2-ethylhexyl, nonyl, 2-propylheptyl, decyl, dodecyl, tetradecyl, hexadecyl, octadecyl, oleyl, or combinations thereof. In one embodiment, the (thio)phosphate is a mixture of mono- and di- (2-ethyl) hexylphosphate.

The N-hydrocarbyl substituted γ-aminoester may be generally depicted as a material represented by the formula

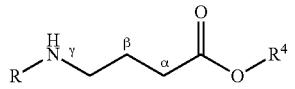

where R may be the hydrocarbyl substituent and R4 may be the residue of the alcohol from which the ester may be envisioned as having been prepared by condensation of an amino acid with an alcohol. If the material may be a thioester, the —OR4 group may be replaced by an —SR4 group. Such a material may be envisioned as derived from the condensation of an acid or acid halide with an appropriate mercaptan R4SH, although in practice it may be prepared by transesterification of an ester with a mercaptan.

The N-hydrocarbyl substituted δ-aminoester may be generally depicted as a material represented by the formula

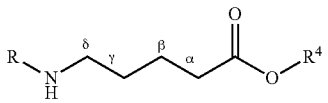

where R may be the hydrocarbyl substituent and R4 may be the residue of the alcohol from which the ester may be envisioned as having been prepared by condensation of an amino acid with an alcohol. If the material may be a thioester, the —OR4 group may be replaced by a —SR4 group. Such a material may be envisioned as derived from the condensation of an acid or acid halide with an appropriate mercaptan R4SH, although in practice it may be prepared by transesterification of an ester with a mercaptan.

The group R4, the alcohol residue portion, may have 1 to 30 or 1 to 18 or 1 to 12 or 2 to 8 carbon atoms. It may be a hydrocarbyl group or a hydrocarbon group. It may be aliphatic, cycloaliphatic, branched aliphatic, or aromatic. In certain embodiments, the R4 group may methyl, ethyl, propyl, isopropyl, n-butyl, iso-butyl, t-butyl, n-hexyl, cyclohexyl, iso-octyl, or 2-ethylhexyl. If R4 is methyl, then the R group, the hydrocarbyl substituent on the nitrogen, will have a branch at the 1-position.

In other embodiments the R4 group may be an ether-containing group. For instance, it may be an ether-containing group or a polyether-containing group which may contain, for instance 2 to 120 carbon atoms along with oxygen atoms representing the ether functionality. When R4 is an ether-containing group, it may be represented by the general formula

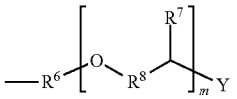

wherein R6 may be a hydrocarbyl group of 1 to 30 carbon atoms; R7 may be H or a hydrocarbyl group of 1 to about 10 carbon atoms; R8 may be a straight- or branched-chain hydrocarbylene group of 1 to 6 carbon atoms; Y may be —H, —OH, —R6OH, —NR9R10, or —R6NR9R10, where R9 and R10 are each independently H or a hydrocarbyl group of 1 to 50 carbon atoms, and m may be an integer from 2 to 50. An example of a mono-ether group would be —CH2-O—CH3. Polyether groups include groups based on poly(alkylene glycols) such as polyethylene glycols, polypropylene glycols, and poly(ethylene/propylene glycol) copolymers. Such polyalkylene glycols are commercially available under the trade names UCON® OSP Base fluids, Synalox® fluids, and Brij® polyalkeylene glycols. They may be terminated with an alkyl group (that is, Y may be H) or with a hydroxy group or other such groups as mentioned above. If the terminal group is OH, then R4 would also be considered a hydroxy-containing group, much as described in the paragraph below (albeit not specifically a hydroxy-containing alkyl group) and may be esterified as described in the paragraph below.

In another embodiment, R4 can be a hydroxy-containing alkyl group or a polyhydroxy-containing alkyl group having 2 to 12 carbon atoms. Such materials may be based on a diol such as ethylene glycol or propylene glycol, one of the hydroxy groups of which may be reacted to form the ester linkage, leaving one unesterified hydroxy group. Another example of a material may be glycerin, which, after condensation, may leave one or two hydroxy groups. Other polyhydroxy materials include pentaerythritol and trimethylolpropane. Optionally, one or more of the hydroxy groups may be reacted to form an ester or a thioester. In one embodiment, one or more of the hydroxy groups within R4 may be condensed with or attached to an additional

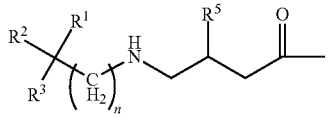

group so as to from a bridged species.

In one embodiment the N-substituted amino(thio)ester may contain one or more additional substituents or groups at the α, β, γ, or δ positions (relative to the carboxylic acid moiety) of the amino acid component of the above molecule. In one embodiment there are no such substituents. In another embodiment there may be a substituent at the β position (m=1) or the γ-position (m=2), thus leading to a group of materials represented by the formula

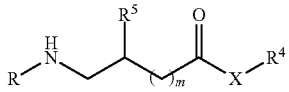

Here R and R4 are as defined above; X may be O or S (in one embodiment, O) and R5 may be hydrogen, a hydrocarbyl group, or a group represented by —C(═O)—R6 where R6 may be hydrogen, an alkyl group, or —X'—R7, where X' may be O or S and R7 may be a hydrocarbyl group of 1 to 30 carbon atoms and m=1 or 2. That is, a substituent at the β position (m=1) or at the γ-position (m=2) of the chain may comprise an ester, thioester, carbonyl, or hydrocarbyl group. When R5 is —C(═O)—R6, the structure may be represented by

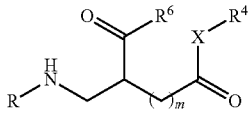

It will be evident that when R6 is —X'—R7 the material will be a substituted succinic acid ester or thioester when m=1 or the material will be a substituted glutaric acid ester or thioester when m=2. In particular, in one embodiment the material may be methyl succinic acid diester (m=1), with amine substitution on the methyl group. In one embodiment the material may be a 2-methyl glutaric acid diester (m=2) with amine substitution on the methyl group. The R4 and R6 groups may be the same or different; in certain embodiments they may independently have 1 to 30 or 1 to 18 carbon atoms, as described above for R4. In certain embodiments, the material may be represented by the structure

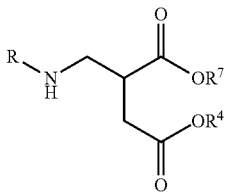

In certain embodiments the material will be or will comprise a 2-((hydrocarbyl)-aminomethyl) succinic acid dihydrocarbyl ester (which may also be referred to as a dihydrocarbyl 2-((hydrocarbyl)aminomethyl) succinate). In certain embodiments the material may be represented by the structure

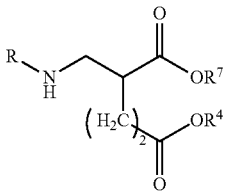

In certain embodiments the material will be or will comprise a 2-((hydrocarbyl)-aminomethyl) glutaric acid dihydrocarbyl ester (which may also be referred to as 2-((hydrocarbyl)-aminomethyl) pentanedioic acid dihydrocarbyl ester.

In certain embodiments there may be a substituent at the β and γ position (relative to the carboxylic acid moiety) of the amino acid thus leading to a group of materials represented by the formula

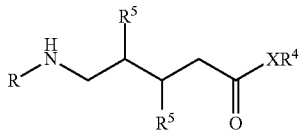

Here R and R4 are as defined above; X may be O or S (in one embodiment, 0) and R5 may be hydrogen, a hydrocarbyl group, or a group represented by —C(═O)—R6 where R6 may be hydrogen, an alkyl group, or —X'—R7, where X' may be O or S and R7 may be a hydrocarbyl group of 1 to 30 carbon atoms. When R5 is —C(═O)—R6, the structure may be represented by

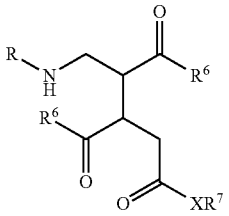

It will be evident that when R6 is —X'—R7 the material will be a substituted 1,2,3-tricarboxylic acid ester or thioester. In particular, in one embodiment the material may be a trihydrocarbyl 4-(hydrocarbylamino)-butane 1,2,3-tricarboxylate or a trihydrocarbyl 4-(hydrocarbylamino)butane-1,2,3-tris (carboxylothioate). In certain embodiments the material may be represented by the structure

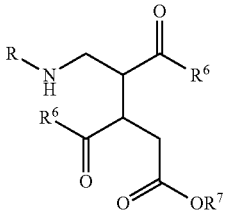

The hydrocarbyl substituent R on the amine nitrogen will comprise a hydrocarbyl group of at least 3 carbon atoms with a branch at the 1 or 2 (that is, α or β) position of the hydrocarbyl chain (not to be confused with the α or β position of the ester group, above). The branched hydrocarbyl group R may be represented by the partial formula

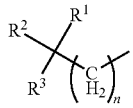

where the bond on the right represents the point of attachment to the nitrogen atom. In this partial structure, n is 0 or 1, R1 is hydrogen or a hydrocarbyl group, R2 and R3 are independently hydrocarbyl groups or together form a carboxylic structure. The hydrocarbyl groups may be aliphatic, cycloaliphatic, or aromatic, or mixtures thereof. When n is 0, the branching is at the 1 or a position. When n is 1, the branching is at the 2 or β position. If R4, above, is methyl, then n will be 0.

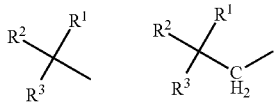

1-or α branching 2-or β branching

There may, of course, be branching both at the 1 position and the 2 position. Attachment to a cyclic structure is to be considered branching:

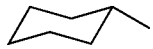

(a type of 1-or α branching)

The branched hydrocarbyl substituent R on the amine nitrogen may thus include such groups as isopropyl, cyclopropyl, sec-butyl, iso-butyl, t-butyl, 1-ethylpropyl, 1,2-dimethylpropyl, neopentyl, cyclohexyl, 4-heptyl, 2-ethyl-1-hexyl (commonly referred to as 2-ethylhexyl), t-octyl (for instance, 1,1-dimethyl-1-hexyl), 4-heptyl, 2-propylheptyl, adamantyl, and α-methylbenzyl.

The amine that may be seen as reacting to form the material of the present technology will be a primary amine, so that the resulting product will be a secondary amine, having a branched R substituent as described above and the nitrogen also being attached to the remainder of the molecule

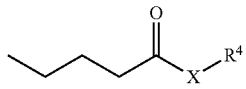

and substituted versions thereof as described above. The left-most (short) bond represents the attachment to the nitrogen atom.

The materials of the disclosed technology may therefore, in certain embodiments, be represented by the structure

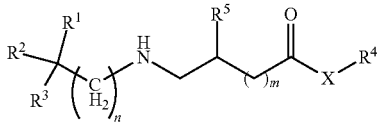

wherein n is 0 or 1, m=1 or 2, R1 is hydrogen or a hydrocarbyl group, R2 and R3 are independently hydrocarbyl groups or together form a carbocyclic structure, X is O or S, R4 is a hydrocarbyl group of 1 to 30 carbon atoms, and R5 is hydrogen, a hydrocarbyl group, or a group represented by —C(=O)—R6 where R6 is hydrogen, an alkyl group, or —X'—R7, where X' is O or S and R7 is a hydrocarbyl group of 1 to 30 carbon atoms. In certain embodiments, the materials may be represented by the structure

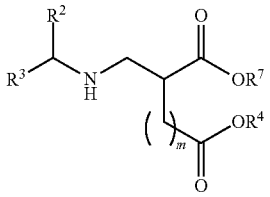

wherein m=1 or 2, R2 and R3 are independently alkyl groups of 1 to 6 carbon atoms and R4 and R7 are independently alkyl groups of 1 to 12 carbon atoms. In other embodiments, the materials may be represented by the structure

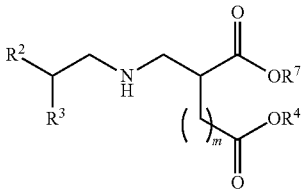

wherein m, R2, R3, R4, and R7 are as defined above.

The N-hydrocarbyl-substituted γ-aminoester, γ-aminothioester, δ-aminoester or δ-aminothioester materials disclosed herein may be prepared by a Michael addition of a primary amine, having a branched hydrocarbyl group as described above, with an ethylenically unsaturated ester or thio ester of the type described above. The ethylenic unsaturation would be between the β and γ carbon atoms (when m=1) or the γ and δ carbon atoms (when m=2) of the ester. Thus, the reaction may occur generally as

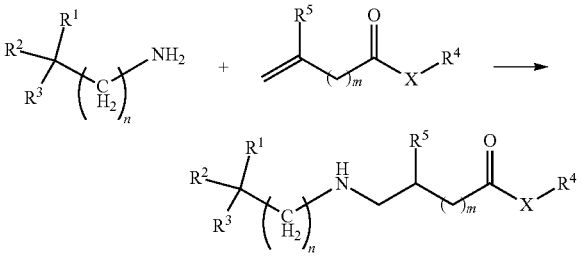

where the X and R groups are as defined above and m=1 or 2. In one embodiment the ethylenically unsaturated ester may be an ester of itaconic acid, in which the reaction may be

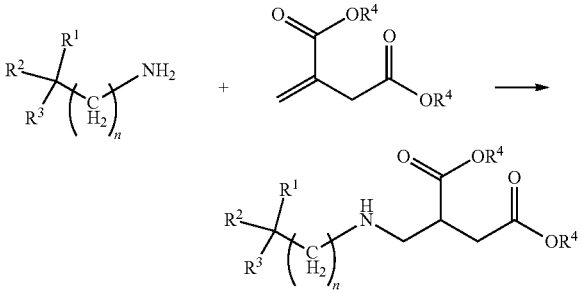

In one embodiment the ethylenically unsaturated ester may be an ester of methylene glutaric acid in which the reaction may be

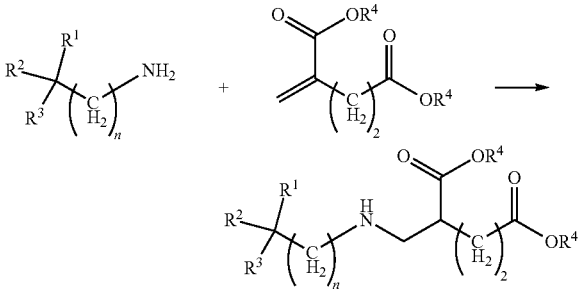

In one embodiment the ethylenically unsaturated ester may be an ester of a but-3-ene-1,2,3-tricarboxylic acid in which the reaction may be

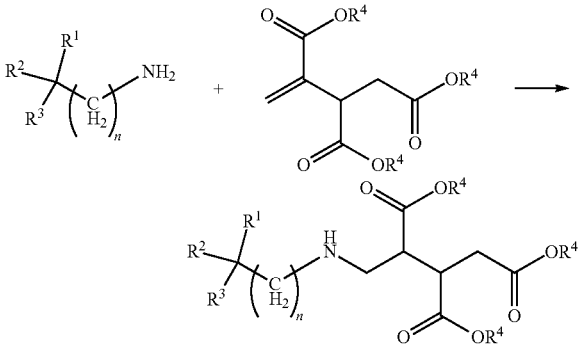

In one embodiment, the amine reactant is not a tertiary hydrocarbyl (e.g., t-alkyl) primary amine, that is, n is not zero while R1, R2, and R3 are each hydrocarbyl groups. The reaction product formed from a t-alkyl primary amine may exhibit thermal instability. The reaction may be conducted in a solvent such as methanol and may employ a catalyst such as a zirconium (Zr)-based catalyst or may be conducted in the absence of catalyst. (A suitable Zr-based catalyst may be prepared by combining an aqueous solution of ZrOCL2 with a substrate such as montmorillonite clay, with heating followed by drying.) Relative amounts of the reactants and the catalyst may be varied within bounds that will be apparent to the person skilled in the art. The ester and the amine may be used in approximately a 1:1 molar ratio, or alternatively with a slight molar excess of one reactant or the other, e.g., a ratio of ester:amine of 0.9:1 to 1.2:1, or 1:1 to 1.1:1, or 1.02:1 to 1.08:1. The amount of Zr catalyst, if used, (excluding support material) may be, for example, 0.5 to 5 g per 100 g of reactants (amine+ester), or 1 to 4 g, or 2 to 3 g, per 100 g of reactants. The Michael addition reaction may be conducted at a temperature of 10 to 33° C., or alternatively 15 to 30° C. or 18 to 27° C. or 20 to 25° C. or yet in other embodiments 10 to 80° C. or 15 to 70° C. or 18 to 60° C. or 20 to 55° C. or 25 to 50° C. or 30 to 50° C. or 45 to 55° C. Solvent may be used during the reaction if desired, and a suitable solvent may be an alcohol such as methanol or other protic solvent, which, in certain embodiments, is typical. If such a solvent is present, it may be present in an amount of 5 to 80 percent by weight of the total reaction mixture (including the solvent), for instance, 10 to 70% or 12 to 60% or 15 to 50% or 18 to 40% or 20 to 30% or 18 to 25%, or about 20%. The presence of such a solvent may lead to an increased rate of reaction and may facilitate reaction at lower temperatures. In one embodiment 20% methanol is present with dibutyl itaconate and α-methylbenzylamine (i.e. 1-phenylethanamine), and the reaction is conducted at 50° C. Specific optimum conditions may vary depending on the materials employed and can be determined by the person of ordinary skill. At the end of the reaction, the catalyst may be removed by filtration and the solvent, if any, may be removed by evaporation under vacuum. The solvent may be removed under vacuum at a temperature of up to 40° C. or up to 35° C. or up to 30° C. or up to 27° C. or up to 25° C.

In one embodiment the (thio)phosphoric acid salt may be a (thio)phosphoric acid salt of N-hydrocarbyl-substituted delta-amino(thio)ester. The delta-amino(thio)ester may have a similar definition as presented above for the gamma-amino (thio)ester, except the N-hydrocarbyl substitution is at the delta-position rather than the gamma position.

The (thio)phosphoric acid salt of the delta-amino(thio) ester may be prepared by similar processes described above for the (thio)phosphoric acid salt of the gamma-amino(thio) ester.

Oils of Lubricating Viscosity

The lubricant composition of the present invention also contains an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricant composition may be in the form of a concentrate and/or a fully formulated lubricant. If the lubricant composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricant composition may be prepared by adding the amine salt of the thiophosphate described herein above to an oil of lubricating viscosity, optionally in the presence of other performance additives (as described herein below).

The lubricant composition of the invention may further include other additives. In one embodiment the invention provides a lubricant composition further comprising at least one of a dispersant, an antiwear agent (other than the (thio)phosphoric acid salt of the present invention), a dispersant viscosity modifier, a friction modifier, a viscosity modifier, an antioxidant, an overbased detergent, a foam inhibitor, a demulsifier, a pour point depressant or mixtures thereof. In one embodiment the invention provides a lubricant composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates, phenates, and salicylates), or mixtures thereof.

In one embodiment the lubricant composition of the invention further comprises an overbased metal-containing detergent, or mixtures thereof.

Overbased detergents are known in the art. Overbased materials, otherwise referred to as overbased or superbased salts, are generally single phase, homogeneous systems characterised by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, typically carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio" is also explained in standard textbook entitled "Chemistry and Technology of Lubricants", Third Edition, Edited by R. M. Mortier and S. T. Orszulik, Copyright 2010, page 219, sub-heading 7.25.

The overbased metal-containing detergent may be chosen from non-sulphur-containing phenates, sulphur-containing phenates, sulphonates, salixarates, salicylates, carboxylates, and mixtures thereof, or borated equivalents thereof. The overbased detergent may be borated with a borating agent such as boric acid.

The overbased detergent may be non-sulphur containing phenates, sulphur containing phenates, sulphonates, or mixtures thereof.

The lubricant may further comprise an overbased sulphonate detergent present at 0.01 wt % to 0.9 wt %, or 0.05 wt % to 0.8 wt %, or 0.1 wt % to 0.7 wt %, or 0.2 wt % to 0.6 wt %.

The overbased sulphonate detergent may have a metal ratio of 12 to less than 20, or 12 to 18, or 20 to 30, or 22 to 25.

The lubricant composition may also include one or more detergents in addition to the overbased sulphonate.

Overbased sulphonates typically have a total base number of 250 to 600, or 300 to 500 (on an oil free basis). Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment the overbased sulphonate detergent comprises an overbased calcium sulphonate. The calcium sulphonate detergent may have a metal ratio of 18 to 40 and a TBN of 300 to 500, or 325 to 425.

The other detergents may have a metal of the metal-containing detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

The other detergent may have an alkali metal, an alkaline earth metal, or zinc counterion. In one embodiment the metal may be sodium, calcium, barium, or magnesium. Typically other detergent may be sodium, calcium, or magnesium containing detergent (typically, calcium, or magnesium containing detergent).

The other detergent may typically be an overbased detergent of sodium, calcium or magnesium salt of the phenates, sulphur-containing phenates, salixarates and salicylates. Overbased phenates and salicylates typically have a total base number of 180 to 450 TBN (on an oil free basis).

Phenate detergents are typically derived from p-hydrocarbyl phenols. Alkylphenols of this type may be coupled with sulphur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP.

The overbased detergent may be present at 0 wt % to 10 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricant composition. For a passenger car engine the detergent may be present at 0.2 wt % to 1 wt % of the lubricant composition. In one embodiment, an engine lubricant composition comprises at least one overbased detergent with a metal ratio of at least 3, or at least 8, or at least 15.

The lubricant composition may further include a dispersant, or mixtures thereof. The dispersant may be chosen from a succinimide dispersant, a Mannich dispersant, a succinamide dispersant, a polyolefin succinic acid ester, amide, or ester-amide, or mixtures thereof.

In one embodiment the invention does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be chosen from ethylenediamine, diethylenetriamine, triethylenetetramine, tetraethylenepentamine, pentaethylene-hexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride may be derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant may be reacted with dimercaptothiadiazoles. In one embodiment the post-treated dispersant may be reacted with phosphoric or phosphorous acid. In one embodiment the post-treated dispersant may be reacted with terephthalic acid and boric acid (as described in US Patent Application US2009/0054278.

In one embodiment the dispersant may be borated or non-borated. Typically a borated dispersant may be a succinimide dispersant. In one embodiment, the ashless dispersant may be boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition may be free of a boron-containing dispersant, i.e. delivers no more than 10 ppm boron to the final formulation.

The dispersant may be prepared/obtained/obtainable from reaction of succinic anhydride by an "ene" or "thermal" reaction, by what may be referred to as a "direct alkylation process". The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

In one embodiment the dispersant may be a succinimide dispersant may comprise a polyisobutylene succinimide, wherein the polyisobutylene from which polyisobutylene succinimide is derived has a number average molecular weight of 350 to 5000, or 750 to 2500.

The dispersant may be present at 0 wt % to 20 wt %, 0.1 wt % to 15 wt %, or 0.5 wt % to 9 wt %, or 1 wt % to 8.5 wt % or 1.5 to 5 wt % of the lubricant composition.

In one embodiment the lubricant composition may be a lubricant composition further comprising a molybdenum compound. The molybdenum compound may be an antiwear agent or an antioxidant. The molybdenum compound may be chosen from molybdenum dialkyldithiophosphates, molybdenum dithiocarbamates, amine salts of molybdenum compounds, and mixtures thereof. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum by weight.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricant composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricant composition.

In one embodiment the lubricant composition further comprises a phenolic or an aminic antioxidant or mixtures thereof, and wherein the antioxidant is present at 0.1 wt % to 3 wt %, or 0.5 wt % to 2.75 wt %, or 1 wt % to 2.5 wt %.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Molyvan 822®, Molyvan® A and Molyvan® 855 from R. T. Vanderbilt Co., Ltd., and Adeka Sakura-Lube™ S-100, S-165, S-600 and 525, or mixtures thereof.

In one embodiment the lubricant composition further includes a viscosity modifier. The viscosity modifier is known in the art and may include hydrogenated styrene-butadiene rubbers, ethylene-propylene copolymers, ethylene copolymers with propylene and higher olefins, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof. The viscosity modifier may include a block copolymer comprising (i) a vinyl aromatic monomer block and (ii), a conjugated diene olefin monomer block (such as a hydrogenated styrene-butadiene copolymer or a hydrogenated styrene-isoprene copolymer), a polymethacrylate, an ethylene-alpha olefin copolymer, a hydrogenated star polymer comprising conjugated diene monomers such as butadiene or isoprene, or a star polymer of polymethacrylate, or mixtures thereof.

The dispersant viscosity modifier may include functionalized polyolefins, for example, ethylene-propylene copolymers that have been functionalized with an acylating agent such as maleic anhydride and an amine.

In one particular embodiment the dispersant viscosity modifier comprises an olefin copolymer further functionalized with a dispersant amine group. Typically, the olefin copolymer is an ethylene-propylene copolymer.

The olefin copolymer has a number average molecular weight of 5000 to 20,000, or 6000 to 18,000, or 7000 to 15,000.

The olefin copolymer may have a shear stability index of 0 to 20, or 0 to 10, or 0 to 5 as measured by the Orbahn shear test (ASTM D6278) as described above.

The formation of a dispersant viscosity modifier is well known in the art. The dispersant viscosity modifier may include for instance those described in U.S. Pat. No. 7,790,661 column 2, line 48 to column 10, line 38.

In one embodiment the dispersant viscosity modifier may be prepared by grafting of an olefinic carboxylic acid acylating agent onto a polymer of 15 to 80 mole percent of ethylene, from 20 to 85 mole percent of $C_{3-10}$ α-monoolefin, and from 0 to 15 mole percent of non-conjugated diene or triene, said polymer having an average molecular weight (Mw) ranging from 5000 to 20,000, and further reacting said grafted polymer with an amine (typically an aromatic amine).

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. Suitable amines may be aliphatic or aromatic amines and polyamines. Examples of suitable aromatic amines include nitroaniline, aminodiphenylamine (ADPA), hydrocarbylene coupled polyaromatic amines, and mixtures thereof. More detailed description of dispersant viscosity modifiers are disclosed in International Publication WO2006/015130 or U.S. Pat. Nos. 4,863,623; 6,107,257; 6,107,258; 6,117,825; and U.S. Pat. No. 7,790,661.

In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricant composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricant composition.

In one embodiment the friction modifier may be chosen from long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty malic esters and imides, fatty (poly)glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricant composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters such as glycerol mono-oleate; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricant composition optionally further includes at least one antiwear agent different from that of the invention.

Examples of suitable antiwear agents include titanium compounds, tartaric acid derivatives such as tartrate esters, amides or tartrimides, malic acid derivatives, citric acid derivatives, glycolic acid derivatives, oil soluble amine salts of phosphorus compounds different from that of the invention, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thio-carbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

The lubricant composition may further include a phosphorus-containing antiwear agent different from that of the invention. Typically the phosphorus-containing antiwear agent may be a zinc dialkyldithiophosphate, phosphite, phosphate, phosphonate, and ammonium phosphate salts, or mixtures thereof.

In one embodiment the lubricant composition may further comprise a phosphorus-containing antiwear agent, typically zinc dialkyldithiophosphate.

Zinc dialkyldithiophosphates are known in the art. Examples of zinc dithiophosphates include zinc isopropyl methylamyl dithiophosphate, zinc isopropyl isooctyl dithiophosphate, zinc di(cyclohexyl) dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, and combinations thereof. Zinc dialkyldithiophosphate may be present in amount to provide 0.01 wt % to 0.1 wt % phosphorus to the lubricating composition, or to provide 0.015 wt % to 0.075 wt % phosphorus, or 0.02 wt % to 0.05 wt % phosphorus to the lubricating composition.

In one embodiment, the lubricant composition further comprises one or more zinc dialkyldithiophosphate such that the amine (thio)phosphate additive of the invention provides at least 50% of the total phosphorus present in the lubricating composition, or at least 70% of the total phosphorus, or at least 90% of the total phosphorus in the lubricating composition. In one embodiment, the lubricant composition is free or substantially free of a zinc dialkyldithiophosphate.

The antiwear agent may be present at 0 wt % to 3 wt %, or 0.1 wt % to 1.5 wt %, or 0.5 wt % to 0.9 wt % of the lubricant composition.

In one embodiment the lubricant composition comprising an oil of lubricating viscosity and 0.01 wt % to 15 wt % of a (thio)phosphoric acid salt of an N-hydrocarbyl-substituted gamma- (γ-) or delta-amino(thio)ester further comprises 0.01 to 5 wt % or 0.1 to 2 wt % of an ashless antiwear agent represented by Formula:

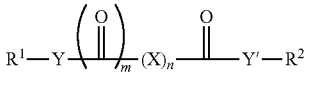

wherein

Y and Y' are independently —O—, >NH, >NR$^3$, or an imide group formed by taking together both Y and Y' groups and forming a R$^1$—N< group between two >C═O groups; X is independently —Z—O—Z'—, >CH$_2$, >CHR$^4$, >CR$^4$R$^5$, >C(OH)(CO$_2$R$^2$), >C(CO$_2$R$^2$)$_2$, or >CHOR$^6$;

Z and Z' are independently >CH$_2$, >CHR$^4$, >CR$^4$R$^5$, >C(OH)(CO$_2$R$^2$), or >CHOR$^6$;

n is 0 to 10, with the proviso that when n=1, X is not >CH$_2$, and when n=2, both X's are not >CH$_2$;

m is 0 or 1;

R$^1$ is independently hydrogen or a hydrocarbyl group, typically containing 1 to 150 carbon atoms, with the proviso that when R$^1$ is hydrogen, m is 0, and n is more than or equal to 1;

R$^2$ is a hydrocarbyl group, typically containing 1 to 150 carbon atoms;

R$^3$, R$^4$ and R$^5$ are independently hydrocarbyl groups; and

R$^6$ is hydrogen or a hydrocarbyl group, typically containing 1 to 150 carbon atoms.

In one embodiment the lubricant composition comprising an oil of lubricating viscosity and 0.01 wt % to 15 wt % of a (thio)phosphoric acid salt of an N-hydrocarbyl-substituted gamma- (γ-) or delta-amino(thio)ester further comprises 0.01 to 5 wt % or 0.1 to 2 wt % of an ashless antiwear agent that may be a compound obtained/obtainable by a process comprising reacting a glycolic acid, a 2-halo-acetic acid, or a lactic acid, or an alkali or alkaline metal salt thereof, (typically glycolic acid or a 2-halo-acetic acid) with at least one member selected from the group consisting of an amine, an alcohol, and an aminoalcohol. For example the compound may be represented by formulae:

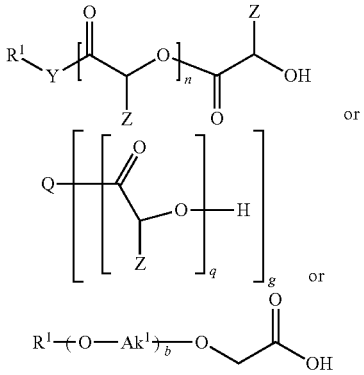

wherein

Y is independently oxygen or >NH or >NR$^1$;

R$^1$ is independently a hydrocarbyl group, typically containing 4 to 30, or 6 to 20, or 8 to 18 carbon atoms;

Z is hydrogen or methyl;

Q is the residue of a diol, triol or higher polyol, a diamine, triamine, or higher polyamine, or an aminoalcohol (typically Q is a diol, diamine or aminoalcohol)

g is 2 to 6, or 2 to 3, or 2;

q is 1 to 4, or 1 to 3 or 1 to 2;

n is 0 to 10, 0 to 6, 0 to 5, 1 to 4, or 1 to 3; and

Ak$^1$ is an alkylene group containing 1 to 5, or 2 to 4 or 2 to 3 (typically ethylene) carbon atoms; and b is 1 to 10, or 2 to 8, or 4 to 6, or 4.

The compound is known and is described in International publication WO 2011/022317, and also in granted U.S. Pat. Nos. 8,404,625, 8,530,395, and 8,557,755.

In one embodiment the lubricant composition comprising an oil of lubricating viscosity and 0.01 wt % to 15 wt % of a (thio)phosphoric acid salt of an N-hydrocarbyl-substituted gamma- (γ-) or delta-amino(thio)ester further comprises 0.01 to 5 wt % or 0.1 to 2 wt % of an ashless antiwear agent that may be an imide or eater of a hydroxycarboxylic acid derivative described above.

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyether of the invention.

Metal deactivators may be chosen from a derivative of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine. The metal deactivators may also be described as corrosion inhibitors.

Seal swell agents include sulpholene derivatives Exxon Necton-37™ (FN 1380) and Exxon Mineral Seal Oil™ (FN 3200).

In one embodiment the lubricant comprises 0.05 wt % to 3 wt %, or 0.1 wt % to 2 wt %, or 0.2 wt % to 1.5 wt % of the (thio)phosphoric acid salt of an N-hydrocarbyl-substituted gamma- (γ-) or delta-amino(thio)ester.

An engine lubricant composition in different embodiments may have a composition as disclosed in the following table:

| | Embodiments (wt %) | | |
|---|---|---|---|
| Additive | A | B | C |
| (thio)phosphoric Acid Salt | 0.05 to 3 | 0.1 to 2 | 0.2 to 1.5 |
| Corrosion Inhibitor | 0.05 to 2 | 0.1 to 1 | 0.2 to 0.5 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

The lubricant composition may further comprise:

0.1 wt % to 6 wt %, or 0.4 wt % to 3 wt % of an overbased detergent chosen from a calcium or magnesium non-sulphur containing phenate, a calcium or magnesium a sulphur containing phenate, or a calcium or magnesium sulphonate, 0.5 wt % to 10 wt %, or 1.2 wt % to 6 wt % a polyisobutylene succinimide, wherein the polyisobutylene of the polyisobutylene succinimide has a number average molecular weight of 550 to 3000, or 1550 to 2550, or 1950 to 2250.

0.05 wt % to 5 wt %, or 0.1 wt % to 2 wt % of an ethylene-propylene copolymer, 0.1 wt % to 5 wt %, or 0.3 wt % to 2 wt % of the (thio)phosphoric acid salt of an N-hydrocarbyl-substituted gamma- (γ-) or delta-amino(thio)ester, and zinc dialkyldithiophosphate present in an amount to deliver 0 ppm to 900 ppm, or 100 ppm to 800 ppm, or 200 to 500 ppm of phosphorus.

INDUSTRIAL APPLICATION

In one embodiment the invention provides a method of lubricating an internal combustion engine. The engine components may have a surface of steel or aluminum.

An aluminum surface may be derived from an aluminum alloy that may be a eutectic or a hyper-eutectic aluminum alloy (such as those derived from aluminum silicates, aluminum oxides, or other ceramic materials). The aluminum surface may be present on a cylinder bore, cylinder block, or piston ring having an aluminum alloy, or aluminum composite.

The internal combustion engine may or may not have an exhaust gas recirculation system. The internal combustion engine may be fitted with an emission control system or a turbocharger. Examples of the emission control system include diesel particulate filters (DPF), Gasoline Particulate Filters (GPF), Three-Way Catalyst (TWC) or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine. In one embodiment the internal combustion engine may be a gasoline engine such as a gasoline direct injection engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.2 wt % or 1.1 wt % of the lubricant composition. In one embodiment the sulphated ash content may be 0.5 wt % to 1.2 wt % of the lubricant composition.

In one embodiment the lubricant composition may be an engine oil, wherein the lubricant composition may be characterized as having at least one of (i) a sulphur content of 0.5 wt % or less, (ii) a phosphorus content of 0.12 wt % or less, and (iii) a sulphated ash content of 0.5 wt % to 1.1 wt % of the lubricant composition.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

The following examples provide illustrations of the invention. These examples are non-exhaustive and are not intended to limit the scope of the invention.

EXAMPLES

Preparative Amine 1 (AM1): Dibutyl itaconate (100 g) and methanol (39.7 g) are charged to a 3-neck vessel fitted with a condenser, magnetic stirrer, nitrogen inlet, and thermocouple. The mixture is stirred and 45 parts by weight of α-methylbenzylamine is added dropwise over about 45 minutes, during which time the temperature of the mixture is maintained at about 24-27° C. The mixture is then heated to about 50° C. and stirred for approximately 20 hours, and thereafter the methanol is removed by rotary vacuum drying under high vacuum, maintaining the temperature below 40° C. The product is believed to be dibutyl 2-(((α-methylbenzyl)amino)methyl)succinate, 140.7 parts by weight.

Preparative Amine 2 (AM2): Bis(2-ethylhexyl)itaconate (47.0 g), methanol (100 g), and 5.0 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 16.3 g of 2-ethylhexylamine is added dropwise over 15 minutes (or alternatively, 3-4 minutes), during which time the temperature of the mixture is 18-27° C. (alternatively, up to 30° C. or 33° C.). The mixture is stirred for an additional 5 hours, then filtered to remove the catalyst. Methanol is removed from the filtrate by rotary vacuum drying under high vacuum, maintaining the temperature below 25° C. The product is believed to be bis(2-ethylhexyl) 2-(((2-ethylhexyl)amino)methyl) succinate, 49.5 g.

Preparative Amine 3 (AM3): Bis(2-ethylhexyl)itaconate (150 g) and 2-ethylhexanol (30 g) are charged to a 250 mL 3-neck flack fitted with a condenser, magnetic stirrer, nitrogen inlet, and thermocouple. The mixture is stirred at room temperature and then 107.3 g of oleylamine is added dropwise over 1 hour, during which time the temperature of the mixture is 20-2 5° C. The mixture is then heated to 30° C. and stirred for an additional 2.5 hours, then filtered to remove the catalyst. The product is believed to be bis(2-ethylhexyl)2-((oleyl amino)methyl) succinate containing 2-ethylhexanol, 278 g.

Preparative Amine 4 (AM4): Bis (oleyl)itaconate (250 g) and butanol (32.5 g) are charged to a 250 mL 3-neck flack fitted with a condenser, magnetic stirrer, nitrogen inlet, and thermocouple. The mixture is stirred at room temperature and 43.3 g of α-methylbenzylamine is added dropwise over 1 hour, during which time the temperature of the mixture is maintained at 20-25° C. The mixture is then heated to 50° C. and stirred for 10 hours. Methanol is removed from by rotary vacuum drying under high vacuum, maintaining the temperature below 25° C. The product is believed to be bis (oleyl)2-(((α-methylbenzyl)amino)methyl) succinate, 255 g.

Preparative Amine 5 (AM5): Bis(2-ethylhexyl)itaconate (461.7 g), methanol (150 g), and 6.3 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 146.9 g of 2,4,4-trimethylpentan-2-amine is added dropwise over approximately 1 hour, during which time the temperature of the mixture is 20-25° C. The mixture is heated to 30° C. and stirred for an additional 6 hours, then heated to 66° C. and heated for a further 11 hours, then filtered to remove the catalyst. Methanol is removed from the filtrate by rotary vacuum drying under high vacuum, maintaining the temperature below 25° C. The product is believed to be bis(2-ethylhexyl)2-((2,4,4-trimethylpentan-2-amino) methyl) succinate, 575.9 g.

Preparative Amine 6 (AM6): Bis(2-ethylhexyl)itaconate (270.6 g), methanol (160 g), and 6 g of a Zr based catalyst are charged to a 250 mL 3-neck flack fitted with a condenser, magnetic stirrer, nitrogen inlet, and thermocouple. (The Zr catalyst is prepared by combining an aqueous solution of 33.5 g $ZrOCl_2$ with 66.5 g montmorillonite clay with heating followed by drying.) The mixture is stirred at room temperature and 77.6 g of tertiary butylamine is added dropwise over approximately 1 hour, during which time the temperature of the mixture is 14-20° C. The mixture is heated to 30° C. and stirred for a 12 hours, then filtered to remove the catalyst. Methanol is removed from the filtrate by rotary vacuum drying under high vacuum, maintaining the temperature below 25° C. The product is believed to be bis(2-ethylhexyl)2-((2-methylpropan-2-amino)methyl) succinate, 286.7 g.

Preparative Amine 7-9 (AM7-9)

Preparative Amine 7 (AM7)—Reaction product of 2-ethylhexylamine and itaconic acid di-oleylester.

Preparation Amine 8 (AM8)—Reaction product of 2,4,4-trimethylpentan-2-amine with itaconic acid di-n-butylester.

Preparation Amine 9 (AM9)—Reaction product of tert-butylamine with itaconic acid di-n-butylester.

Preparation Amine 10-15 (AM-10-15): The procedures of Preparation Amine 1-6 may be repeated replacing the dibutyl itaconates with dibutyl 2-methylenepentanedioate, the bis(2-ethylhexyl)itaconate with bis(2-ethylhexyl)2-methylene pentanedioate, or the bis (oleyl)itaconates with bis (oleyl)2-methylene pentanedioate.

Preparative Amine 10 (AM10)—Reaction product of 1-phenylethanamine with dibutyl 2-methylenepentanedioate.

Preparative Amine 11 (AM11)—Reaction product of 2-ethylhexylamine and bis(2-ethylhexyl)2-methylene pentanedioate.

Preparative Amine 12 (AM12)—Reaction product of oleylamine and bis(2-ethylhexyl)2-methylene pentanedioate.

Preparative Amine 13 (AM13)—Reaction product of 2-ethylhexylamine and bis(oleyl)2-methylene pentanedioate.

Preparative Amine 14 (AM14)—Reaction product of 1-phenylethanamine with bis(oleyl)2-methylene pentanedioate.

Preparation Amine 15 (AM15)—Reaction product of 2,4,4-trimethylpentan-2-amine with dibutyl 2-methylenepentanedioate.

Preparation Amine 16-21 (AM16-21): The procedures of Preparation Amine 1-6 may be repeated replacing the dibutyl itaconates with tributyl but-3-ene-1,2,3-tricarboxylate, the bis(2-ethylhexyl)itaconate with tris(2-ethylhexyl) but-3-ene-1,2,3-tricarboxylate, or the bis(oleyl)itaconates with tris (oleyl) but-3-ene-1,2,3-tricarboxylate.

Preparative Amine 16 (AM16)—Reaction product of 1-phenylethanamine with tributyl but-3-ene-1,2,3-tricarboxylate.

Preparative Amine 17 (AM17)—Reaction product of 2-ethylhexylamine and tris(2-ethylhexyl) but-3-ene-1,2,3-tricarboxylate.

Preparative Amine 18 (AM18)—Reaction product of oleylamine and tris(2-ethylhexyl) but-3-ene-1,2,3-tricarboxylate.

Preparative Amine 19 (AM19)—Reaction product of 2-ethylhexylamine and with tris(oleyl) but-3-ene-1,2,3-tricarboxylate Preparative Amine 20 (AM20)—Reaction product of 1-phenylethanamine with with tris(oleyl) but-3-ene-1,2,3-tricarboxylate.

Preparation Amine 21 (AM21)—Reaction product of 2,4,4-trimethylpentan-2-amine with tributyl but-3-ene-1,2,3-tricarboxylate.

Preparation Amine 22 (AM22)—Reaction product of □-methylbenzylamine with 2-ethylhexyl itaconate.

General Procedure for Formation of Phosphate Acid Esters

Alcohol is charged to a dried multineck-neck flange flask fitted with a condenser, an overhead mechanica stirrer, nitrogen inlet, and thermocouple. The flask is heated to 70° C. and then phosphorus pentoxide is added portionwise, maintaining the temperature at 70 to 80° C. The mixture is then heated to 90° C. and stirred for an additional 3 to 20 hours. The molar ratio of the alcohol to phosphorus pentoxide ($P_2O_5$) may be 4:1 to 2.5:1 that is for every phosphorus there is typically 2 to 1.25 equivalents alcohol.

2-ethylhexanol (636.8 g) and 1,2-propanediol (67.7 g) are charged to a dried 2 L multineck-neck flange flask fitted with a condenser, overhead mechanical stirrer, nitrogen inlet, and thermocouple. The flask is heated to 70° C. and then phosphorus pentoxide (273.4 g) is added portionwise over approximately 1.5 hours, maintain the temperature at 70 to 80° C. The mixture is then heated to 90° C. and stirred for an additional 12 to 15 hours.

2-ethylhexanol (2512 g) is charged to a dried 5 L multineck-neck flange flask fitted with a condenser, overhead mechanical stirrer, nitrogen inlet, and thermocouple. The flask is heated to 70° C. and then phosphorus pentoxide (887 g) is added portionwise over approximately 3 hours, maintain the temperature at 70 to 80° C. The mixture is then heated to 90° C. and stirred for an additional 10 to 15 hours.

General Procedure for Formation of Salts

This process is common to all preparative salts of the itaconate amines (AM1 through AM21) and protic acids. The example below is for a 2-ethylhexylphosphate salted with the alpha methylbenzylamine dibutyl itaconate adduct.

A mixture of 2-ethylhexylphosphate and bis-2-ethylhexylphosphate acid ester (225 g) are charged to a 500 ml mL 3-neck flack fitted with a condenser, magnetic stirrer, nitrogen inlet, and thermocouple. To the flask is added AM1, dibutyl 2-(((α-methylbenzyl)amino)methyl) succinate (326.95) over approximately 1 hour, during this time an exotherm of approximately 5-10° C. This process is common to all preparative itaconate amines (AM1 through AM21) and is controlled by gentle cooling to the keep the temperature of the vessel at 20-25° C. After the addition, the reaction is stirred at 25-30° C. for 2 hours.

All additional salts are made by a similar process. The materials prepared are summarized Table 1:

TABLE 1

Preparative Amine-Phosphate Salts

| | Amine | (Thio)Phosphate |
|---|---|---|
| PREP1 | AM1 | di-(2-ethylhexyl)phosphate (EHP) |
| PREP2 | AM2 | EHP |
| PREP3 | AM1 | (n-decyl)phosphate (DP) |
| PREP4 | AM3 | EHP |
| PREP5 | AM7 | EHP |
| PREP6 | AM5 | EHP |

TABLE 1-continued

Preparative Amine-Phosphate Salts

| | Amine | (Thio)Phosphate |
|---|---|---|
| PREP7 | AM8 | EHP |
| PREP8 | AM9 | EHP |
| PREP9 | AM1 | (isooctyl)phosphate (OP) |
| PREP10 | AM1 | (isopropyl/methylamyl) phosphate (IMP) |
| PREP11 | AM1 | (isopropyl/methylamyl) dithiophosphate (IMTP) |
| PREP12 | AM6 | IMP |
| PREP19 | AM10 | EHP |
| PREP25 | AM22 | Mixture of 1,2-propane diol and 2-ethylhexanol (mole ratio 1:5.5) phosphate |
| PREP26 | AM5 | Mixture of 1,2-propane diol and 4-methyl-2-pentanol (mole ratio 1:5.5) phosphate |
| PREP27 | AM6 | Mixture of 1,2-propane diol and 4-methyl-2-pentanol (mole ratio 1:5.5) phosphate |
| PPREP28 | AM1 | Mixture of 1,2-propane diol and 4-methyl-2-pentanol (mole ratio 1:5.5) phosphate |
| PREP29 | AM8 | Mixture of 1,2-propane diol and 4-methyl-2-pentanol (mole ratio 1:5.5) phosphate |
| COMP PREP25 | 2-EHA | OP |

Footnote:
The phosphate product is typically in the form of a mixture of mono- and di-phosphates.

Study 1

A series of 5W-30 engine lubricants in Group III base oil of lubricating viscosity are prepared containing the additives described above as well as conventional additives including polymeric viscosity modifier, ashless succinimide dispersant, overbased detergents, antioxidants (combination of phenolic ester, diarylamine, and sulphurized olefin), zinc dialkyldithiophosphate (ZDDP), as well as other performance additives as follows (Table 2).

TABLE 2

Lubricant Compositions

| | CEX1 | CEX2 | CEX3 | Oil 1 | Oil 2 | Oil 3 |
|---|---|---|---|---|---|---|
| Base Oil | | | | | | |
| PREP1 | | | | 1.7 | 1.7 | |
| PREP2 | | | | | | 2.9 |
| PREP3 | | | | | | |
| PREP6 | | | | | | |
| FM[1a] | 0 | 0.5 | 0 | 0.5 | 0 | 0.5 |
| FM[1b] | 0 | 0 | 0.5 | 0 | 0.5 | 0 |
| Sulfonate[2a] | 1.0 | 1.0 | 1.0 | 1.0 | 1.0 | 1.0 |
| Phenate[2b] | 0.76 | 0.76 | 0.76 | 0.76 | 0.76 | 0.76 |
| ZDDP[3] | 0 | 0 | 0 | 0 | 0 | 0 |
| Antioxidant[4] | 0.44 | 0.44 | 0.44 | 0.44 | 0.44 | 0.44 |
| Dispersant[5] | 3.1 | 3.1 | 3.1 | 3.1 | 3.1 | 3.1 |
| Viscosity Modifier[6] | 1.0 | 1.0 | 1.0 | 1.0 | 1.0 | 1.0 |
| Additional additives[7] | 0.34 | 0.34 | 0.34 | 0.34 | 0.34 | 0.34 |
| % Phos | 0 | 0 | 0 | 0.0727 | 0.0731 | 0.0795 |

| | Oil 4 | Oil 5 | Oil 6 | Oil 7 | Oil 8 | Oil 9 |
|---|---|---|---|---|---|---|
| Base Oil | | | | | | |
| PREP1 | | | | | | |
| PREP2 | 2.9 | | | | | |
| PREP3 | | 4.37 | 4.37 | | | |
| PREP6 | | | | 1.62 | 1.62 | |
| PREP17 | | | | | | 1.5 |
| FM[1a] | 0 | 0.5 | 0 | 0.5 | 0 | 0.5 |
| FM[1b] | 0.5 | 0 | 0.5 | 0 | 0.5 | 0 |

TABLE 2-continued

| Lubricant Compositions | | | | | | |
|---|---|---|---|---|---|---|
| Sulfonate[2a] | 1.0 | 1.0 | 1.0 | 1.0 | 1.0 | 1.0 |
| Phenate[2b] | 0.76 | 0.76 | 0.76 | 0.76 | 0.76 | 0.76 |
| ZDDP[3] | 0 | 0 | 0 | 0 | 0 | 0.5 |
| Antioxidant[4] | 0.44 | 0.44 | 0.44 | 0.44 | 0.44 | 0.44 |
| Dispersant[5] | 3.1 | 3.1 | 3.1 | 3.1 | 3.1 | 3.1 |
| Viscosity Modifier[6] | 1.0 | 1.0 | 1.0 | 1.0 | 1.0 | 1.0 |
| Additional additives[7] | 0.34 | 0.34 | 0.34 | 0.34 | 0.34 | 0.34 |
| % Phos | 0.079 | 0.0761 | 0.0766 | 0.083 | 0.0832 | 0.0500 |

[1a]Oleyl Tartrimide
[1b]Tartaric acid, di-(C12-15 alkyl) ester
[2a]Overbased calcium sulfonate detergents
[2b]Overbased calcium phenate detergents
[3]Secondary ZDDP derived from mixture of C3 and C6 alcohols
[4]Sulphurized olefin
[5]Succinimide dispersant derived from succinated polyisobutylene (Mn 2000)
[6]Ethylene-propylene copolymer with Mn of 90,000
[7]Additional additives include surfactant, corrosion inhibitor, anti-foam agents, and pour-point depressants The lubricants are evaluated for wear performance in a programmed temperature high frequency reciprocating rig (HFRR) available from PCS Instruments. HFRR conditions for the evaluations are 200 g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness are then measured with lower wear scar values and higher film formation values indicating improved wear performance.

The percent film thickness is based on the measurement of electrical potential between an upper and a lower metal test plate in the HFRR. When the film thickness is 100%, there is a high electrical potential for the full length of the 1000 micrometer stroke, suggesting no metal to metal contact. Conversely for a film thickness of 0% there is no electrical potential suggesting continual metal to metal contact between the plates. For intermediate film thicknesses, there is an electrical potential suggesting the upper and lower metal test plate have a degree of metal to metal contact as well as other areas with no metal to metal contact. The wear scar, coefficient of friction and film formation results obtained are presented in the following table:

| Example | C.o.F | Wear Scar (μm) | % Film Thickness |
|---|---|---|---|
| CEX1 | 0.162 | 203 | 43 |
| CEX2 | 0.111 | 131 | 96 |
| CEX3 | 0.127 | 127 | 98 |
| Oil 1 | 0.110 | 102 | 98 |
| Oil 2 | 0.135 | 110 | 95 |
| Oil 3 | 0.120 | 122 | 98 |
| Oil 4 | 0.124 | 129 | 98 |
| Oil 5 | 0.111 | 69 | 98 |
| Oil 6 | 0.126 | 126 | 98 |
| Oil 7 | 0.117 | 116 | 97 |
| Oil 8 | 0.144 | 119 | 91 |

The results obtained indicate that the lubricant of the present invention is capable of being able to provide at least one of (i) reduced or equivalent anti-wear performance, (ii) reduced lead or copper corrosion, (iii) retention of total base number of the lubricant, (iv) decreased deposit formation, (v) improved fuel economy and/or (vi) improved seal compatibility in the operation of a mechanical device.

Study 2

Comparative Example 4 and 5 (CEX4 and CEX5): Two heavy duty diesel engine lubricants are prepared containing 0.95 wt % of zinc dialkyldithiophosphate, 1.5 wt % (including 50 wt % diluent oil) of 85 TBN calcium sulfonate, 1.1 wt % (including 42 wt % diluent oil) of magnesium sulfonate, 1 wt % (including 50 wt % diluent oil) magnesium saligenin, 1.1 wt % of a mixture of aminic and phenolic antioxidants, 0.75% of ethylene-propylene based viscosity modifier. The engine lubricant has a sulphated ash content of 0.94 wt %, 0.3 wt % of sulphur, and 950 ppm of phosphorus. Comparative Example 5 further contains 0.87 wt % of the product of Preparative Amine 1 (AM1) described above.

CEX4 and CEX5 are evaluated for wear performance in HFRR using the process described above. The results obtained are:

| Example | C.o.F | Wear Scar (μm) | % Film Thickness |
|---|---|---|---|
| CEX4 | 0.141 | 187 | 95 |
| CEX5 | 0.133 | 180 | 78 |

The results indicate that adding the product of AM1 in Comparative Example 2 does not have an effect of increasing or reducing antiwear performance. In summary the non-salted product does not have appreciable antiwear performance.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein TBN may be measure by ASTM Methods D2896 or D4739, typically 52896; and TAN is generally measure by ASTM Method D664.

As described hereinafter the molecular weight of the viscosity modifier has been determined using known methods, such as GPC analysis using polystyrene standards. Methods for determining molecular weights of polymers are well known. The methods are described for instance: (i) P. J. Flory, "Principles of Polymer Chemistry", Cornell University Press 91953), Chapter VII, pp 266-315; or (ii) "Macromolecules, an Introduction to Polymer Science", F. A. Bovey and F. H. Winslow, Editors, Academic Press (1979), pp 296-312. As used herein the weight average and number weight average molecular weights of the polymers of the invention are obtained by integrating the area under the peak corresponding to the polymer of the invention, which is normally the major high molecular weight peak, excluding peaks associated with diluents, impurities, uncoupled polymer chains and other additives.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricant composition comprising an oil of lubricating viscosity and 0.01 wt % to 15 wt % of a (thio)phosphoric acid salt of an N-hydrocarbyl-substituted gamma- (γ-) or delta-amino(thio)ester.

2. The lubricant of claim 1, the amino(thio)ester comprises a N-hydrocarbyl-substituted gamma- amino(thio)ester.

3. The lubricant of claim 1, the amino(thio)ester comprises a N-hydrocarbyl-substituted gamma- aminoester.

4. The lubricant of claim 1, wherein the amino(thio)ester has a N-hydrocarbyl substituent that comprises a hydrocarbyl group of at least 3 carbons atoms, with a branch at the 1 or 2 position of the hydrocarbyl group, provided that if the ester or thioester is a methyl ester or methyl thioester then the hydrocarbyl group has a branch at the 1 position, and further provided that the hydrocarbyl group is not a tertiary group.

5. The lubricant composition of claim 4, wherein the amino(thio)ester comprises a 2-((hydrocarbyl)aminomethyl) succinic acid dihydrocarbyl ester.

6. The lubricant composition of claim 4, wherein the ester functionality comprises an alcohol-derived group which is a hydrocarbyl group having 1 to about 30 carbon atoms.

7. The lubricant composition of claim 4 wherein the ester functionality comprises an alcohol-derived group which is an ether-containing group.

8. The lubricant composition of claim 1, wherein the amino(thio)ester comprises first and second ester functionalities, and wherein the first and second ester functionalities each comprise an alcohol-derived groups having an alkyl moiety which is the same or different and having 1 to about 18 carbon atoms.

9. The lubricant composition of claim 1, wherein the amino(thio)ester is represented by the formula

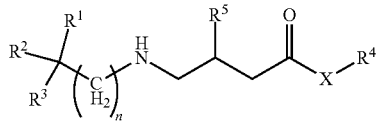

wherein n is 0 or 1, $R^1$ is hydrogen or a hydrocarbyl group, $R^2$ and $R^3$ are independently hydrocarbyl groups or together form a carbocyclic structure, X is O or S, $R^4$ is a hydrocarbyl group of 1 to about 30 carbon atoms, and $R^5$ is hydrogen, a hydrocarbyl group, or a group represented by C(═O)—$R^6$ where $R^6$ is hydrogen, an alkyl group, or —X'—$R^7$, where X' is O or S and $R^7$ is a hydrocarbyl group of 1 to about 30 carbon atoms, provided that if $R^4$ is methyl, then n is 0, and further provided that if n is 0, $R^1$ is hydrogen.

10. The lubricant composition of claim 1, wherein the amino(thio)ester is represented by the formula

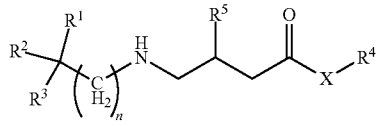

wherein n is 0 or 1, $R^1$ is hydrogen or a hydrocarbyl group, $R^2$ and $R^3$ are independently hydrocarbyl groups or together form a carbocyclic structure, X is O or S, $R^4$ is an ether-containing group or a polyether-containing group, having 2 to about 120 carbon atoms, and $R^5$ is hydrogen, a hydrocarbyl group, or a group represented by C(═O)—$R^6$ where $R^6$ is hydrogen, an alkyl group, or —X'—$R^7$, where X' is O or S and $R^7$ is a hydrocarbyl group of 1 to about 30 carbon atoms, provided that if $R^4$ is methyl, then n is 0, and further provided that if n is 0, $R^1$ is hydrogen.

11. The lubricant composition of claim 10, wherein $R^4$ is represented by

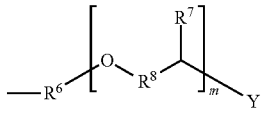

wherein $R^6$ is a hydrocarbyl group of 1 to about 30 carbon atoms;

$R^7$ is H or a hydrocarbyl group of 1 to about 10 carbon atoms;

$R^8$ is a straight or branched chain hydrocarbylene group of 1 to 6 carbon atoms;

Y is —H, —OH, —$R^6$OH, —$NR^9R^{10}$, or —$R^6NR^9R^{10}$, where $R^9$ and $R^{10}$ are each independently H or a hydrocarbyl group of 1 to 50 carbon atoms, and m is an integer from 2 to 50.

12. The lubricant composition of claim 1, wherein the amino(thio)ester is represented by the formula

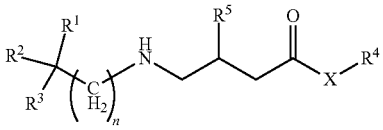

wherein n is 0 or 1, $R^1$ is hydrogen or a hydrocarbyl group, $R^2$ and $R^3$ are independently hydrocarbyl groups or together form a carbocyclic structure, X is O or S, $R^4$ is a hydroxy-containing or a polyhydroxy-containing alkyl group of 2 to about 12 carbon atoms, at least one hydroxy group being optionally reacted to form an ester or a thioester, and $R^5$ is hydrogen, a hydrocarbyl group, or a group represented by —C(═O)—$R^6$ where $R^6$ is hydrogen, an alkyl group, or —X'—$R^7$, where X is O or S and $R^7$ is a hydrocarbyl group of 1 to about 30 carbon atoms, provided that if $R^4$ is methyl, then n is 0, and further provided that if n is 0, $R^1$ is hydrogen.

13. The lubricant composition of claim 12, wherein the amino(thio)ester is represented by the formula

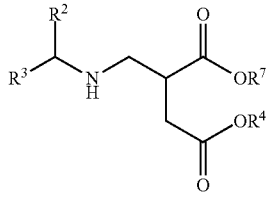

wherein $R^2$ and $R^3$ are independently alkyl groups of 1 to about 6 carbon atoms and $R^4$ and $R^7$ are independently alkyl groups of 1 to about 12 carbon atoms.

14. The lubricant composition of claim 1, wherein the (thio)phosphoric acid salt of an N-hydrocarbyl-substituted amino(thio)ester is obtained/obtainable by reacting an N-hydrocarbyl-substituted amino(thio)ester with a (thio)phosphoric acid, ester, or a partial acid-ester thereof.

15. The lubricant composition of claim 14, wherein the amino(thio)ester has a N-hydrocarbyl substituent that comprises a hydrocarbyl group of at least 3 carbons atoms, with a branch at the 1 or 2 position of the hydrocarbyl group, provided that if the ester or thioester is a methyl ester or methyl thioester then the hydrocarbyl group has a branch at the 1 position, and further provided that the hydrocarbyl group is not a tertiary group (thio)phosphoric acid salt of an N-hydrocarbyl-substituted amino(thio)ester, is obtained/obtainable by reacting the N-hydrocarbyl-substituted N-hydrocarbyl-substituted amino(thio)ester with a (thio)phosphoric acid, ester, or a partial acid-ester thereof.

16. The lubricant of claim 1, wherein the (thio)phosphoric acid comprises a mono- or di- hydrocarbyl (thio)phosphoric acid, or mixtures thereof.

17. The lubricant of claim 16, wherein the alkyl of the mono- or di- hydrocarbyl (thio)phosphoric acid comprises linear alkyl groups of 3 to 36 carbon atoms.

18. The lubricant of claim 16, wherein the alkyl of the mono- or di- hydrocarbyl (thio)phosphoric acid comprises branched alkyl groups of 3 to 36 carbon atoms.

19. The lubricant of claim 1, wherein the oil of lubricating viscosity comprises API Group I, II, III, IV, V, or mixtures thereof.

20. The lubricant of claim 19 further comprising at least one of a succinimide dispersant, a Mannich dispersant, a succinamide dispersant, a polyolefin succinic acid ester, amide, or ester-amide dispersant, or mixtures thereof.

21. The lubricant of claim 20 further comprising a detergent selected from the group consisting of non-sulphur containing phenates, sulphur containing phenates, sulphonates, salixarates, salicylates, borated equivalents thereof and mixtures thereof.

22. The lubricant of claim 21 further comprising a phosphorus-containing antiwear agent.

23. The lubricant of claim 21 further comprising a viscosity modifier selected from the group consisting of hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers, esters of maleic anhydride-styrene copolymers, and mixtures thereof.

24. The lubricant of claim 21 further comprising a corrosion inhibitor selected from the group consisting of a derivative of benzotriazole, 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride or a fatty acid with a polyamine and mixtures thereof.

25. A method of lubricating an internal combustion engine comprising supplying to the internal combustion engine a lubricant of claim 1.

26. The method of claim 25, wherein the internal combustion engine has a steel surface on a cylinder bore, cylinder block, or piston ring.

27. The method of claim 25, wherein the internal combustion engine has a surface of steel, or an aluminum alloy, or an aluminum composite.

28. The method of claim 25, wherein the lubricant further comprises a phenolic or an aminic antioxidant or mixtures thereof, and wherein the antioxidant is present at 0.1 wt % to 3 wt %.

29. The method of claim 25, wherein the lubricant further comprises an overbased sulphonate detergent present at 0.01 wt % to 0.9 wt %.

30. The method of claim 29, wherein the overbased sulphonate detergent comprises an overbased calcium sulphonate having a metal ratio of 18 to 40.

31. The method of claim 29, wherein the lubricant further comprises 0.01 wt % to 2 wt % of a second detergent wherein the second detergent is selected from the group consisting of non-sulphur containing phenates, sulphur containing phenates, sulphonates, salixarates, salicylates, borated equivalents thereof and mixtures thereof.

32. The method of claim 25 wherein the lubricant further comprises a phosphorus-containing antiwear agent.

33. The method of claim 25, wherein the lubricant is characterised as having (i) a sulphur content of 0.5 wt % or less, (ii) a phosphorus content of 0.15 wt % or less, and (iii) a sulphated ash content of 0.5 wt % to 1.5 wt % or less.

34. The method of claim 25, wherein the lubricant is characterised as having at least one of (i) a sulphur content of 0.2 wt % to 0.4 wt % or less, (ii) a phosphorus content of 0.08 wt % to 0.15 wt %, and (iii) a sulphated ash content of 0.5 wt % to 1.5 wt % or less.

35. The method of claim 25, wherein the lubricant has a sulphated ash content of 0.5 wt % to 1.2 wt %.

36. The method of claim 25, wherein the lubricant comprises 0.1 wt % to 2 wt % of the (thio)phosphoric acid salt of an N-hydrocarbyl-substituted gamma- (γ-) or delta-amino (thio)ester.

37. The method of claim 25, wherein the lubricant comprises:

0.1 wt % to 6 wt % of an overbased detergent chosen from a calcium or magnesium non-sulphur containing phenate, a calcium or magnesium a sulphur containing phenate, or a calcium or magnesium sulphonate;

0.5 wt % to 10 wt % of a polyisobutylene succinimide, wherein the polyisobutylene of the polyisobutylene succinimide has a number average molecular weight of 550 to 3000;

0.05 wt % to 5 wt % of an ethylene-propylene copolymer;

0.1 wt % to 5 wt % of the (thio)phosphoric acid salt of an N-hydrocarbyl-substituted gamma- (γ-) or delta- amino (thio)ester; and zinc dialkyldithiophosphate present in an amount to deliver 100 ppm to 800 ppm of phosphorus.

38. The method of claim 37, wherein the lubricant has a SAE viscosity grade of XW-Y, wherein X is 0, 5, 10, or 15; and Y is 16, 20, 30, or 40.

39. The method of claim 25, wherein the lubricant further comprises 0.01 to 5 wt % or 0.1 to 2 wt % of an ashless antiwear agent represented by Formula:

Formula

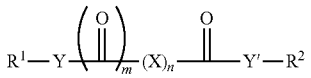

wherein

Y and Y' are independently —O—, >NH, >$NR^3$, or an imide group formed by taking together both Y and Y' groups and forming a $R^1$—N> group between two >C═O groups;

X is independently —Z—O—Z'—, >$CH_2$, >$CHR^4$, >$CR^4R^5$, >C(OH)($CO_2R^2$), >C($CO_2R^2$)$_2$, or >$CHOR^6$;

Z and Z' are independently >$CH_2$, >$CHR^4$, >$CR^4R^5$, >C(OH)($CO_2R^2$), or >$CHOR^6$;

n is 0 to 10, with the proviso that when n=1, X is not >$CH_2$, and when n=2, both X's are not >$CH_2$;

m is 0 or 1;

$R^1$ is independently hydrogen or a hydrocarbyl group, typically containing 1 to 150 carbon atoms, with the proviso that when $R^1$ is hydrogen, m is 0, and n is more than or equal to 1;

$R^2$ is a hydrocarbyl group, typically containing 1 to 150 carbon atoms;

$R^3$, $R^4$ and $R^5$ are independently hydrocarbyl groups; and $R^6$ is hydrogen or a hydrocarbyl group, containing 1 to 150 carbon atoms.

* * * * *